US012276223B2

(12) United States Patent
Buecherl et al.

(10) Patent No.: US 12,276,223 B2
(45) Date of Patent: Apr. 15, 2025

(54) COOLANT CIRCUIT IN A VEHICLE

(71) Applicant: Bayerische Motoren Werke Aktiengesellschaft, Munich (DE)

(72) Inventors: Philipp Buecherl, Schmidgaden (DE); Florian Schneider, Eichenau (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/434,930

(22) PCT Filed: Feb. 5, 2020

(86) PCT No.: PCT/EP2020/052796

§ 371 (c)(1),
(2) Date: Aug. 30, 2021

(87) PCT Pub. No.: WO2020/177963

PCT Pub. Date: Sep. 10, 2020

(65) Prior Publication Data

US 2022/0145794 A1 May 12, 2022

(30) Foreign Application Priority Data

Mar. 5, 2019 (DE) ..... 10 2019 105 505.9

(51) Int. Cl.
*F01P 7/16* (2006.01)
*F01P 3/20* (2006.01)
(Continued)

(52) U.S. Cl.
CPC ..... *F01P 7/16* (2013.01); *F01P 3/20* (2013.01); *F01P 5/10* (2013.01);
(Continued)

(58) Field of Classification Search
CPC ..... F01P 7/16; F01P 2007/146; F01P 7/165; F01P 7/14; F01P 2025/32; F01P 2060/04; F01P 2025/50; F01P 2025/08
See application file for complete search history.

(56) References Cited

U.S. PATENT DOCUMENTS 4,369,738 A 1/1983 Hirayama
5,215,044 A 6/1993 Banzhaf et al.
(Continued)

FOREIGN PATENT DOCUMENTS

CN 101809262 A 8/2010
CN 108138640 A 6/2018
(Continued)

OTHER PUBLICATIONS

EP 3412883 A1 English Translation (Year: 2018).*
(Continued)

*Primary Examiner* — George C Jin
*Assistant Examiner* — Teuta B Holbrook
(74) *Attorney, Agent, or Firm* — Crowell & Moring LLP

(57) ABSTRACT

A coolant circuit in a vehicle includes a first flow control unit disposed in a main duct between an engine and a radiator. The first flow control unit, as a function of a temperature of a coolant, thermostatically controls a flow of the coolant. A bypass duct is fluidically disposed parallel to the radiator where the bypass duct opens into the main duct after the radiator and branches off the main duct between the engine and the first flow control unit. A second flow control unit is disposed in the bypass duct where the second flow control unit is configured such that the second flow control unit opens or closes the bypass duct as a function of the temperature of the coolant.

4 Claims, 2 Drawing Sheets

(51) Int. Cl.
*F01P 5/10* (2006.01)
*F01P 7/14* (2006.01)

(52) U.S. Cl.
CPC ..... *F01P 2007/146* (2013.01); *F01P 2025/08* (2013.01); *F01P 2060/04* (2013.01)

(56) References Cited

U.S. PATENT DOCUMENTS

| | | | | |
|---|---|---|---|---|
| 7,263,954 | B2 * | 9/2007 | Piddock | F01P 7/167 123/41.08 |
| 7,730,855 | B2 | 6/2010 | Lemberger et al. | |
| 7,757,960 | B2 | 7/2010 | Heldberg | |
| 2004/0079298 | A1 | 4/2004 | Kobayashi et al. | |
| 2006/0254538 | A1 * | 11/2006 | Hassdenteufel | F28F 9/0234 123/41.1 |
| 2007/0079774 | A1 * | 4/2007 | Heldberg | F01P 7/165 123/41.1 |
| 2012/0132154 | A1 * | 5/2012 | Suzuki | F01P 7/164 123/41.02 |
| 2016/0290216 | A1 * | 10/2016 | Katragadda | F28D 20/028 |
| 2017/0058753 | A1 * | 3/2017 | Lee | F16K 31/52416 |
| 2017/0248065 | A1 * | 8/2017 | Liu | F16H 57/0436 |

FOREIGN PATENT DOCUMENTS

| | | | | |
|---|---|---|---|---|
| CN | 109154227 | A * | 1/2019 | F01K 23/10 |
| CN | 109236450 | A * | 1/2019 | |
| DE | 41 04 093 | A1 | 8/1992 | |
| DE | 100 28 280 | A1 | 4/2001 | |
| DE | 101 55 386 | A1 | 5/2003 | |
| DE | 10 2004 058 864 | A1 | 6/2006 | |
| DE | 10 2005 018 904 | B3 | 1/2007 | |
| DE | 10 2006 051 851 | A1 | 5/2008 | |
| DE | 20 2008 005 465 | U1 | 8/2008 | |
| DE | 10 2007 011 673 | A1 | 9/2008 | |
| DE | 102014226093 | A1 * | 6/2016 | |
| EP | 0 499 071 | A1 | 8/1992 | |
| EP | 1 614 873 | A2 | 1/2006 | |
| EP | 3412883 | A1 * | 12/2018 | F01P 3/02 |
| GB | 2429763 | A * | 3/2007 | F01M 5/021 |
| WO | WO 2014/041273 | A1 | 3/2014 | |
| WO | WO-2017034456 | A1 * | 3/2017 | |
| WO | WO-2017213573 | A1 * | 12/2017 | B60H 1/00278 |

OTHER PUBLICATIONS

Chinese Office Action issued in Chinese application No. 202080007336.4 dated Jul. 5, 2022, with English translation (Fifteen (15) pages).

PCT/EP2020/052796, International Search Report dated Apr. 8, 2020 (Three (3) pages).

German-language German Office Action issued in German application No. 10 2019 105 505.9 dated Oct. 14, 2019 (Six (6) pages).

German-language German Office Action issued in German application No. 10 2019 105 505.9 dated May 5, 2021 (Six (6) pages).

German-language German Office Action issued in German application No. 10 2019 105 505.9 dated Feb. 10, 2023 (Ten (10) pages).

* cited by examiner

COOLANT CIRCUIT IN A VEHICLE

BACKGROUND AND SUMMARY OF THE INVENTION

The invention relates to a coolant circuit in a vehicle, having a pump, an engine to be cooled, and a radiator.

In order for the functionality of an engine in a vehicle to be ensured, the engine has to be constantly cooled once the operating temperature of the engine has been reached. To this end, a coolant circuit which fundamentally comprises a pump, an engine to be cooled, and a radiator is provided in typical vehicles. During operation, coolant is pumped into the hot engine by the pump, the heat of the engine being absorbed in the hot engine. The heated coolant is thereafter pumped onward into the radiator where the heated coolant is cooled by air, for example. The cooled coolant is thereafter pumped back to the pump, and the circuit recommences.

In situations in which the engine and the coolant are cold (for example when cold-staring a vehicle), the rapid warmup of the engine, which is desirable in this situation, is delayed by the afore-described coolant circuit. For this reason, a thermostat and a bypass line by way of which the coolant can be directed past the radiator are provided between the engine and the radiator so as to control the coolant temperature in generic coolant circuits. If the temperature of the coolant is below a threshold value, the main line between the engine and the radiator will be closed by the thermostat and the bypass line will be opened. The coolant is thus directed past the radiator and accordingly not cooled. As a result, the engine and the coolant heat up more rapidly, the warmup time of the engine being consequently reduced. When the engine and the coolant have reached the respective operating temperature, the thermostat opens the main line to the same extent as it closes the bypass line. Consequently, the coolant flows through the radiator and the temperature of the engine is maintained at a substantially constant level.

DE 100 28 280 A1 discloses a pumping and heating device in a coolant circuit for cooling an engine, a thermostatic valve which opens a bypass line when a temperature of the coolant in the thermostatic valve is below a specific preset temperature, and closes the bypass line and simultaneously releases a line between the radiator and the engine when the temperature of the coolant in the thermostatic valve is above the specific preset temperature, being provided in the coolant circuit.

A two-way thermostat is typically used for controlling the coolant temperature as described above in generic coolant circuits. However, the disposal of such a two-way thermostat in the engine bay is restricted because the two-way thermostat either has to be close to the engine or close to the radiator so that the disposal of the bypass line can be designed in a simple manner.

It is an object of the invention to achieve a simple coolant circuit which has an incorporated bypass line and avoids the previously mentioned disadvantages of generic coolant circuits.

In the coolant circuit according to the invention, two flow control units which are positioned so as to be spatially separated are provided instead of one two-way thermostat. A higher degree of freedom in terms of designing the disposal of components in the engine bay can be achieved as a result. By using two flow control units it is moreover possible for the flow of the coolant in the main duct and the bypass duct, respectively, as a function of the engine operating state (coolant temperature, engine rotating speed, or similar) to be controlled in an open loop or closed loop independently of one another. In one embodiment of the coolant circuit according to the invention it is possible for the second flow control unit to actively open or close the bypass duct directly as a function of the temperature of the coolant. This means that the second flow control unit per se senses the temperature of the coolant by way of a temperature sensor and accordingly sets the flow of the coolant. In another embodiment it is possible for the second flow control unit to actively open or close the flow of the coolant through the bypass duct indirectly as a function of the temperature of the coolant. This means that the second, passively acting, flow control unit sets the flow of the coolant through the bypass duct as a consequence of the flow of the coolant set as a function of the temperature by the first flow control unit. The construction of the coolant circuit according to the invention can thus be designed and adapted in a significantly more flexible manner by using two flow control units instead of one two-way thermostat.

One aspect provides that a first temperature sensor is assigned to the first flow control unit and additionally to the second flow control unit, or that, apart from the first temperature sensor which is assigned to the first flow control unit, a second temperature sensor which is assigned to the second flow control unit is provided. A common temperature sensor which for both flow control units senses the temperature of the coolant in one region simplifies the construction of the coolant circuit and minimizes the number of components required. This temperature sensor is preferably an electronic sensor which electronically actuates in each case the actuator of one flow control unit. The other option, having in each case one temperature sensor per flow control unit, enables a wider choice of temperature sensors and actuators. For example, a mechanical, in particular thermomechanical, actuator can thus be used instead of an electronic temperature sensor and an electronically actuated actuator, the mechanical actuator being actuated by way of a temperature sensor integrated in the flow control unit or per se detecting the temperature of the coolant and setting itself as a function of the temperature of the coolant. The properties of the temperature sensors and actuators for both flow control units can be similar or different, for example such that the first flow control unit has an electronic temperature sensor and an electronically actuated actuator, and the second flow control unit has a thermo-mechanical actuator with a temperature sensor integrated therein.

According to a further aspect, the first temperature sensor and/or the second temperature sensor are/is disposed in the engine or in the flow direction directly downstream of the engine, and there detect/detects the temperature of the coolant. By disposing the temperature sensor in the engine or close to the engine it is possible to detect the hottest temperature in the coolant circuit.

A further aspect provides that the first temperature sensor is integrated in the first flow control unit and/or the second temperature sensor is integrated in the second flow control unit. This simplifies the construction and the disposal of electronic signal transmission lines, on the one hand, and a thermo-mechanical actuator can be used in the flow control units, on the other hand.

The first valve of the first flow control unit at low coolant temperatures, in particular below 80° C., is preferably in a position closed to the maximum, and upon reaching an operating temperature of the coolant, in particular as from 95° C., is in a position opened to the maximum, wherein the first valve, as a function of the temperature of the coolant at the first temperature sensor, in a stepless manner is moved to intermediate positions between the two maximum positions. At low coolant temperatures, coolant is thus no longer directed into the radiator, this leading to the cool coolant not being additionally cooled in the radiator, as a result of which the warmup time of the engine can be significantly reduced. A maximum flow to the radiator is guaranteed upon reaching the operating temperature of the coolant, as a result of which the coolant is constantly cooled in the radiator and a substantially consistent operating temperature of the coolant can thus be ensured. The stepless movement of the first valve in intermediate positions between the two maximum positions additionally contributes toward the operating temperature of the coolant being maintained so as to be substantially consistent.

The second valve of the second flow control unit at low coolant temperatures, in particular below 80° C., is preferably in a position opened to the maximum, and upon reaching an operating temperature of the coolant, in particular as from 95° C., is in a position closed to the maximum. At low coolant temperatures, the coolant is thus directed through the bypass duct, past the radiator, and back to the engine. As a result of this shorted coolant circuit, the coolant is heated in a significantly more rapid manner, and the warmup time of the engine is consequently shortened. Upon reaching an operating temperature of the coolant, the bypass duct and thus the shorted coolant circuit are closed by the second valve, as a result of which the maximum available coolant flow can now be directed to the radiator by way of the main duct.

The first flow control unit has in particular an expansion-material thermostat. This type of thermostat is reliable and of a simple construction because the temperature sensor can be integrated in the actuator, or the actuator per se senses the temperature of the coolant. Moreover, the valve of such thermostats can be very accurately controlled in an open loop or closed loop. The flow of coolant between the maximum positions of the first valve can thus be very accurately controlled in a closed loop as a function of the temperature of the coolant, this contributing toward maintaining a substantially consistent coolant temperature in the coolant circuit.

One embodiment provides that the second flow control unit has an expansion-material thermostat. The advantages of an expansion-material thermostat have already been described above. When using in each case one thermostat per flow control unit (for example one expansion-material thermostat in the first flow control unit and one expansion-material thermostat in the second flow control unit), it may be provided that the two flow control units can electronically or mechanically communicate with one another such that, when closing the valve of the one flow control unit, the valve of the other flow control unit is opened to the same extent. This is also conceivable in the context of the other embodiments.

One further embodiment provides that the second valve of the second flow control unit is a pressure valve, in particular a pressure relief valve. The flow of the coolant through the bypass duct is thus not thermostatically controlled by the second flow control unit but by way of a pressure valve. As a result thereof, the second flow control unit is indirectly a function of the temperature. This is because the flow in the main duct is closed by the first flow control unit at low coolant temperatures, this leading to the coolant pressure ahead of the closed valve of the first flow control unit being increased until the coolant pressure exceeds a preset limit value and the pressure valve is opened as a result. When the closed valve of the first flow control unit is opened by virtue of an increase in the temperature of the coolant, the pressure acting on the pressure valve is reduced, the latter being closed as a result. Purely mechanical pressure valves are reliable and have already proven successful, and moreover are of a simple construction because no pressure or temperature sensors and actuators are required here.

Alternatively, it is also conceivable for the pressure valve to be electronically actuated or controlled by an electronic pressure sensor.

According to one further embodiment, the first flow control unit and/or the second flow control unit each have/has one throttle thermostat. In the case of a throttle thermostat, the flow of the coolant is generally throttled until the desired opening temperature provided in the thermostat is reached. Only then does the opening of the valve which releases the flow of the coolant take place, again by way of the temperature.

In one further embodiment of the coolant circuit an oil/coolant heat exchanger is provided. The incorporation of the oil/coolant heat exchanger can lead to further improvement in terms of the engine warmup.

Further advantages and features of the invention are derived from the description hereunder and from the drawings to which reference is made.

DETAILED DESCRIPTION OF THE DRAWINGS

Figure 1:
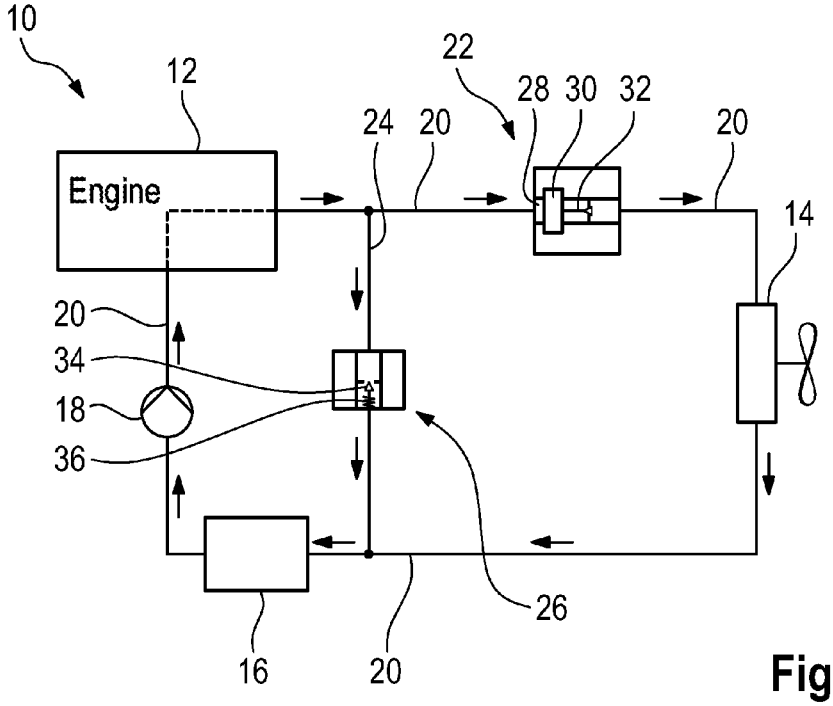
FIG. 1 shows a schematic construction of a first embodiment of a coolant circuit according to the invention.

The coolant circuit 10 shown in FIG. 1 comprises an engine 12, a radiator 14, an oil/coolant heat exchanger 16, and a pump 18. A main duct 20 fluidically connects the engine 12 to the radiator 14, the radiator 14 to the oil/coolant heat exchanger 16, the oil/coolant heat exchanger 16 to the pump 18, and the pump 18 to the engine 12.

A first flow control unit 22 is provided between the engine 12 and the radiator 14.

A bypass duct 24 branches off from the main duct 20 between the engine 12 and the first flow control unit 22. The bypass duct 24 is fluidically disposed so as to be parallel to the radiator 14 and after the radiator 14 opens into the main duct 20.

A second flow control unit 26 is disposed in the bypass duct 24.

The two flow control units 22, 26 in terms of their position and in fluidic terms are disposed so as to be remote from one another in the coolant circuit 10.

In the embodiment shown here, the first flow control unit 22 comprises a first, integrated temperature sensor 28, a first actuator 30, and a first valve 32, all being integrated in the first flow control unit 22.

The first temperature sensor 28 can be, for example, an electronic temperature sensor which electronically actuates the first actuator 30.

Optionally however, the first temperature sensor 28 can also be part of the first actuator 30 which mechanically, or in particular thermo-mechanically, controls in an open loop or closed loop the first valve 32, for example in that an expansion-material sensor simultaneously acts as the actuator 30. The first temperature sensor 28 here is integrated in the first actuator 30 so that the first actuator 30 per se senses the temperature of the coolant, the first temperature sensor 28 thus no longer being an additional external component. For the sake of simplicity, the actuator and the temperature sensor assigned to the actuator are referred to as two individual components in the present application.

The first valve 32 is coupled to the first actuator 30 and, as a function of the coolant temperature, is adjusted in a stepless manner by the first actuator 30. Because the first valve 32 in the first flow control unit 22 is adjusted based on the temperature of the coolant as measured by the first temperature sensor 28, the first flow control unit 22 is directly a function of the temperature of the coolant.

The first flow control unit 22 can be configured as an expansion-material thermostat (for example a wax actuator) and in particular as a throttle thermostat.

The second flow control unit 26 comprises a second valve 34 by which a spring 36 is pre-loaded counter to flow direction of the coolant.

The second valve 34 can be configured as a purely mechanical pressure valve and in particular as a pressure relief valve.

Because the second flow control unit 26 does not comprise any temperature sensor which measures the temperature of the coolant, and based on the latter controls in an open loop or closed loop the flow of the coolant, the second flow control unit 26 is indirectly dependent on the temperature of the coolant. In other words, the second flow control unit 26 is influenced by an adjustment of the first valve 32 of the first flow control unit 22, initiated as a function of the temperature of the coolant, and is a passively operating flow control unit.

In the situation illustrated in FIG. 1, the coolant is cold, as arises when cold-starting a vehicle, for example. The first flow control unit 22 in the embodiment described here comprises an expansion-material thermostat, in particular a throttle thermostat, for example having a wax actuator.

The first actuator 30 is thus not externally actuated and detects "by itself" the temperature of the coolant and accordingly adjusts the first valve 32.

As long as the temperature of the coolant is below a specific, pre-set limit value (for example 80° C.), the first valve 32 is in a position closed to the maximum. Consequently, the flow of the coolant toward the radiator is suppressed and the coolant builds up ahead of the first valve 32.

This leads to an increase in the pressure ahead of the first flow control unit 22 and ahead of the second flow control unit 26. As soon as the pressure ahead of the first flow control unit 22 exceeds a specific limit value, the latter being able to be set by the pre-tension force of the spring 36, for example, the second valve 34 opens and the coolant can flow through the bypass duct 24.

After the bypass duct 24, the coolant opens into the main duct 20 downstream of the radiator 14, and is further pumped into the oil/coolant heat exchanger 16. A thermal exchange between oil and coolant can take place therein.

The coolant is thereafter directed toward the pump 18 where the coolant is pumped further into the engine 12. A thermal transfer from the warming-up engine 12 to the cooler coolant takes place therein.

The heated coolant thereafter flows to the first flow control unit 22 and to the second flow control unit 26. Should the coolant not yet have reached the limit value of the temperature, the first valve 32 remains closed. As long as the first valve 32 is closed, the coolant in the shorted coolant circuit circulates by way of the bypass duct 24, past the radiator 14.

Upon reaching the lower temperature limit value of the coolant, the first actuator 30 in a stepless manner opens the first valve 32 of the first flow control unit 22, as a result of which a partial flow of the coolant toward the radiator 14 is released. The coolant is cooled therein and, downstream of the opening of the bypass duct 24 into the main duct 20, mixes with the warmer coolant. The heating of the coolant in the shorted coolant circuit is reduced as a result thereof.

Upon reaching a predefined operating temperature of the coolant (for example 95° C.), the first valve 32 is in a position opened to the maximum, as a result of which coolant no longer backs up ahead of the first flow control unit 22 and the second flow control unit 26, and the pressure ahead of the second flow control unit 26 consequently drops below the limit value at which the tension force of the spring 36 is greater than the pressure generated by the coolant acting on the second valve 34. As a result, the second valve 34 is in a position closed to the maximum, and the flow of coolant through the second flow control unit 26 is suppressed.

The entire volumetric flow of coolant now flows in the main duct 20 by way of the radiator 14. The coolant is thus constantly heated in the engine 12 and cooled in the radiator 14, as a result of which the coolant temperature can be kept consistent.

Figure 2:
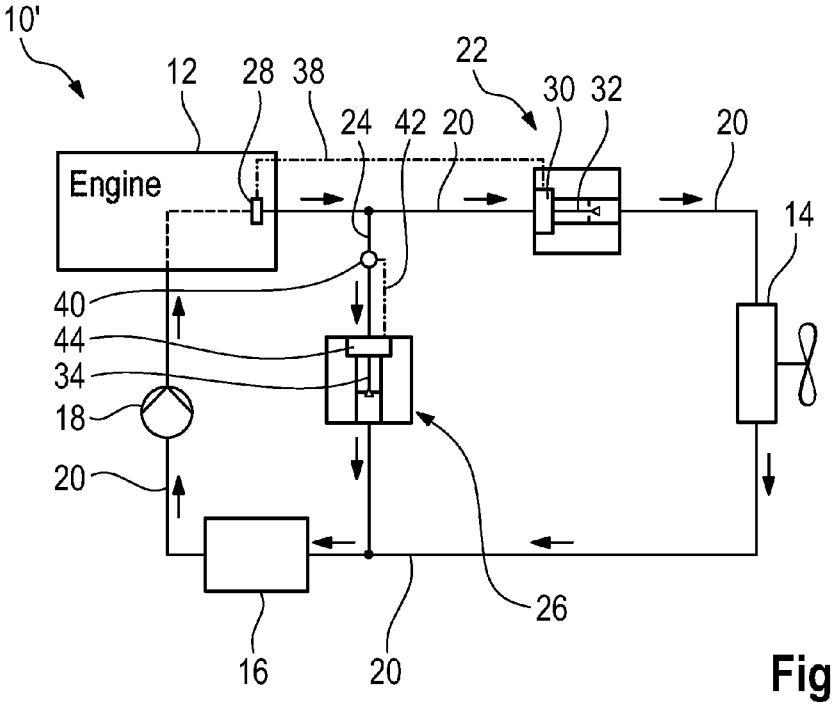
FIG. 2 shows a schematic construction of a second embodiment of the coolant circuit according to the invention.

An embodiment of the coolant circuit 10' which is substantially identical to that of FIG. 1 is shown in FIG. 2. For this reason, a repetition of explanations relating to identical components is dispensed with.

The flow control units 22, 26 in the coolant circuit 10' from FIG. 2 are of a different construction.

In the embodiment shown here, the first temperature sensor 28 is no longer integrated in the first flow control unit 22 but is positioned in the engine 12 so as to be remote from the first flow control unit 22.

It is advantageous for the first temperature sensor 28 to be disposed in the engine 12 or in the flow direction directly downstream of the engine 12, because this makes it possible for the warmest coolant temperatures to be detected.

The first actuator 30 is electronically actuated by the first temperature sensor 28, the latter potentially being configured as an electronic temperature sensor, for example, by way of a signal transmission 38 which can in particular be unidirectional.

The opening and closing of the first valve 32 is performed in a stepless manner, as has already been described in the context of the coolant circuit 10 of FIG. 1, and is a direct function of the temperature of the coolant.

An electronically actuated pressure valve is used instead of a mechanical pressure valve in the coolant circuit 10'. In the embodiment illustrated here, the pressure is detected by means of a pressure sensor 40 which in the flow direction is upstream of the second flow control unit 26.

A second actuator 44 is actuated by the pressure sensor 40 by way of a signal transmission 42 which can in particular be configured so as to be unidirectional.

The second flow control unit 26 can be configured such that it operates only in two operating states (open or closed), that is to say that the second flow control unit 26 is closed or open, respectively, when a specific, preset limit value is undershot or overshot.

The second valve 34 of the second flow control unit 26 can optionally be closed or opened in a stepless manner between a lower pressure limit value and an upper pressure limit value.

The pressure sensor 40 can be freely positioned between the engine 12 and the first flow control unit 22 or the second flow control unit 26.

The first flow control unit 22 and the second flow control unit 26 here can in each case be configured as an electronically actuated throttle thermostat, for example.

In the situation shown here, the engine 12 and the coolant are at the operating temperature. The flow through the first flow control unit 22 toward the radiator 14 is opened, and the flow through the bypass duct 24 is closed by the second flow control unit 26.

Figure 3:
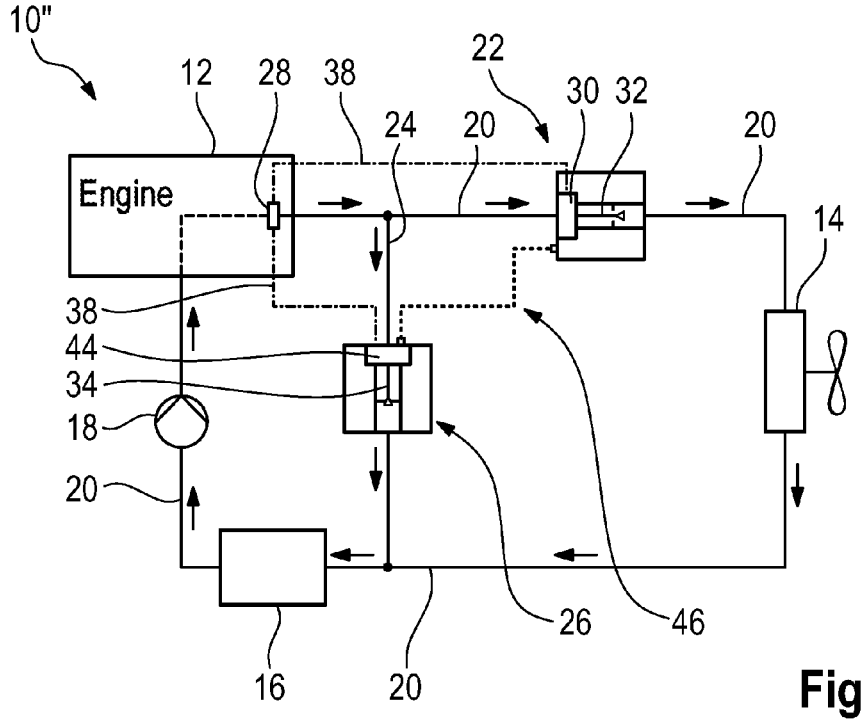
FIG. 3 shows a schematic construction of a third embodiment of the coolant circuit according to the invention.

The coolant circuit 10" shown in FIG. 3 is substantially similar to the coolant circuits 10, 10' shown above, which is why a repetition of explanations relating to identical components is also dispensed with hereunder.

The first temperature sensor 28 in the embodiment shown here of the coolant circuit 10" is assigned to the first flow control unit 22 and the second flow control unit 26.

The first actuator 30 and the second actuator 44 are in each case electronically actuated by a signal transmission 38 from the first temperature sensor 28. The first temperature sensor 28 is positioned in the engine 12 and can be embodied as an electronic temperature sensor, for example.

The first temperature sensor 28 can optionally be positioned directly downstream of the engine 12.

A second temperature sensor 48, which is assigned to the second flow control unit and is likewise positioned in the engine 12 or directly downstream of the engine 12, would also be conceivable.

The first flow control unit 22 and the second flow control unit 26 can in each case be embodied as a throttle thermostat, for example.

The two flow control units 22, 26 are optionally connected by a communications link 46. This means that the two flow control units 22, 26 can exchange, in particular bidirectionally, items of information pertaining to the respective state of the flow control units 22, 26 (for example the degree of opening).

As a result, it is possible for the opening and closing of one flow control unit to be tuned with the closing and opening of the other flow control unit. For example, when opening the first valve 32 of the first flow control unit 22, the second valve 34 of the second flow control unit 26 is thus closed to the same extent.

In the presence of such a communications link 46, the two flow control units 22, 26 do not have to be connected to the first temperature sensor 28 by way of the signal transmission 38. It suffices for only one flow control unit to be connected to the first temperature sensor 28 by way of the signal transmission 38, and to communicate the state of the one flow control unit to the other flow control unit by way of the communications link 46.

The opening and closing of the valves 32, 34 of the flow control units 22, 26 in the embodiment shown here takes place in a stepless manner and is a direct function of the temperature of the coolant.

Figure 4:
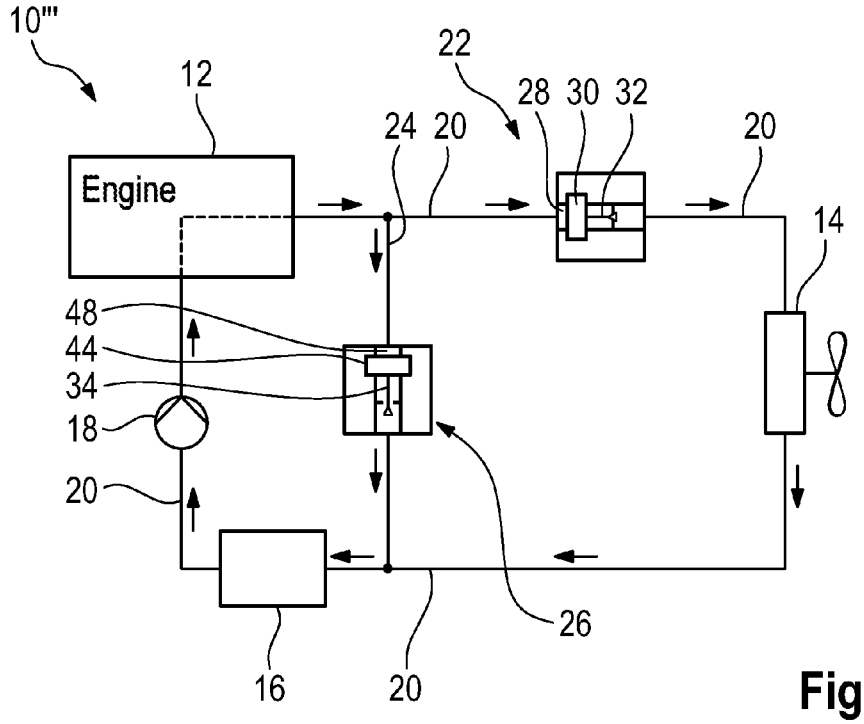
FIG. 4 shows a schematic construction of a fourth embodiment of the coolant circuit according to the invention.

The coolant circuit 10'" shown in FIG. 4 is substantially similar to the coolant circuits 10, 10', 10" shown above, which is why a repetition of explanations relating to identical components is also dispensed with hereunder.

The first temperature sensor 28 in the coolant circuit 10'" is integrated in the first flow control unit 22, and a second temperature sensor 48 is integrated in the second flow control unit 26. Both temperature sensors 28, 48 thus detect the temperature of the coolant in the immediate region of the respective flow control unit 22, 26.

The two flow control units 22, 26 can in each case be configured as an expansion-material thermostat (for example a throttle thermostat).

The temperature sensors 28, 48 here are integrated in the respective actuator 30, 44 so that the actuators 30, 44 sense the temperature of the coolant "by themselves" and, as a function thereof, adjust the respectively assigned valve 32, 34 in a stepless manner.

Consequently, the two flow control units 22, 26 are directly dependent on the temperature of the coolant.

What is claimed is:

1. A coolant circuit in a vehicle, comprising:

a pump;

an engine;

a radiator;

a first flow control unit disposed in a main duct between the engine and the radiator, wherein the first flow control unit has a first valve and an actuator, and wherein the first flow control unit, as a function of a temperature of a coolant, in a stepless manner, thermostatically controls in an open loop or a closed loop a flow of the coolant;

a bypass duct which is fluidically disposed parallel to the radiator, wherein the bypass duct opens into the main duct after the radiator and branches off the main duct between the engine and the first flow control unit;

a second flow control unit disposed in the bypass duct remote from the first flow control unit in the coolant circuit, wherein the second flow control unit has a second valve; and a first temperature sensor disposed in the engine or in a flow direction directly downstream of the engine, wherein the first temperature sensor is assigned to the first flow control unit and the second flow control unit, wherein the first temperature sensor is an electronic temperature sensor that detects the temperature of the coolant, wherein the first flow control unit and the second flow control unit are each an electronically actuated throttle thermostat, wherein the first flow control unit and the second flow control unit are two-state valves that each have exactly one open state permitting coolant flow therethrough and exactly one closed state blocking coolant flow therethrough, and wherein the first flow control unit and the second flow control unit cooperatively open and close the bypass duct, via an inverse open/close state relation to each other, as a function of the temperature of the coolant.

2. The coolant circuit according to claim 1, wherein the first valve of the first flow control unit does not direct the coolant into the radiator at a low temperature of the coolant below 80° C. and directs the coolant at a maximum flow rate into the radiator when an operating temperature of the coolant is reached.

3. The coolant circuit according to claim 1, wherein the second valve of the second flow control unit opens the bypass duct at a low temperature of the coolant below 80° C. and closes the bypass duct when an operating temperature of the coolant is reached.

4. The coolant circuit according to claim 1 further comprising an oil/coolant heat exchanger.

* * * * *